US006012394A

United States Patent [19]

Dion et al.

[11] Patent Number: 6,012,394

[45] Date of Patent: Jan. 11, 2000

[54] CASING FOR PROPELLANT CHARGE

[75] Inventors: Dominique Dion; Régis Aumasson, both of Bourges, France

[73] Assignee: Giat Industries, Versailles, France

[21] Appl. No.: 09/079,189

[22] Filed: May 15, 1998

[30] Foreign Application Priority Data

May 15, 1997 [FR] France ..... 97 05963

[51] Int. Cl.[7] ..... F42B 5/16

[52] U.S. Cl. ..... 102/443; 102/430; 102/466

[58] Field of Search ..... 102/430–434, 102/437, 443, 464, 465, 466, 467, 469, 470, 700

[56] References Cited

U.S. PATENT DOCUMENTS

| | | | |
|---|---|---|---|
| 2,419,949 | 5/1947 | Hottinger . | |
| 2,535,624 | 12/1950 | Burney | 102/443 |
| 2,686,936 | 8/1954 | Tuckerman et al. | 102/700 |
| 2,829,742 | 4/1958 | Wallace . | |
| 2,965,034 | 12/1960 | Heidmann | 29/1.3 |
| 2,977,885 | 4/1961 | Perry, Jr. et al. . | |
| 3,008,412 | 11/1961 | Merdinyan . | |
| 3,095,813 | 7/1963 | Lipinski . | |
| 3,098,444 | 7/1963 | Walkey et al. . | |
| 3,397,639 | 8/1968 | Alderfer . | |
| 3,459,098 | 8/1969 | Donnelly | 102/432 |
| 3,613,588 | 10/1971 | Edlund . | |
| 4,187,271 | 2/1980 | Rolston et al. . | |
| 5,050,502 | 9/1991 | Hellman et al. | 102/430 |
| 5,163,165 | 11/1992 | Desevaux et al. | 102/430 |
| 5,243,914 | 9/1993 | Penner . | |
| 5,400,701 | 3/1995 | Thiesen et al. | 102/443 |
| 5,410,967 | 5/1995 | Peritt | 102/505 |
| 5,493,973 | 2/1996 | Brion et al. | 102/431 |

FOREIGN PATENT DOCUMENTS

| | | | |
|---|---|---|---|
| 0 314 547 A1 | 5/1989 | European Pat. Off. . | |
| 0 526 835 A1 | 2/1993 | European Pat. Off. . | |
| 0 706 025 A1 | 4/1996 | European Pat. Off. . | |
| 503078 | 6/1921 | France . | |
| 307307 | 9/1988 | Germany | 102/430 |
| 3837839 | 6/1989 | Germany | 102/431 |

*Primary Examiner*—Harold J. Tudor
*Attorney, Agent, or Firm*—Oliff & Berridge, PLC

[57] ABSTRACT

A casing for a propellant charge for a piece of ammunition comprises a projectile and a stub. The casing comprises a substantially cylindrical envelope and a closing cover. The cylindrical envelope is made of a plastic material and is in the shape of a lattice formed of strands defining openings. The lattice is formed by a repetitive rectangular mesh. The width of the mesh openings is less than a predetermined diameter of a grain of the propellant charge intended to fill the casing.

13 Claims, 7 Drawing Sheets

CASING FOR PROPELLANT CHARGE

BACKGROUND OF THE INVENTION

1. Field of Invention

The technical scope of the invention is that of propellant charge casings for ammunition.

2. Description of Related Art

A piece of ammunition is known from European Patent No. 314,547 which comprises a fin-stabilized projectile and a casing. In such a piece of ammunition, the propellant charge is incorporated into a part surrounding the tail-piece, which is arranged in a casing connected to the projectile. The casing is made of a combustible material as is the stub.

One of the main drawbacks to this type of casing is its manufacturing and implementation cost. The material is fragile and may deteriorate as the ammunition ages, releasing part of its propellant charge and modifying the ballistic characteristics of the ammunition. The use of a combustible material for the casing also presents risks during the manufacture of the charge, as well as during the component storage phases. Additionally, the risks inherent in using a combustible material require specific installations and procedures to be set up both for the manufacture of the casing and for the storage of the raw materials. Such combustible casings also suffer from other drawbacks.

Thus, although combustible, the cover of the known casing can momentarily form an obstacle to the progression of the priming flame during the first moments of operation of the propellant system. Further, combustible casings can not be reused after disassembly of a piece of ammunition, for example, during the reconditioning of a propellant system after a period of storage. This causes additional costs.

Lastly, it is impossible for a combustible casing to be designed which is able to be used in a piece of ammunition wherein the primer tube must pass through the cover, as well as wherein the primer tube does not pass through the cover. In fact, if a drill hole is provided which passes through the cover, the propellant powder is likely to escape through the hole when the primer tube is not in the hole.

SUMMARY OF THE INVENTION

The aim of the invention is to propose a propellant charge casing which does not suffer from the above-mentioned drawbacks. The invention thus proposes a simple and inexpensive casing which facilitates the assembly of the propellant charge.

The casing according to the invention is made of an inert material, which ensures excellent aging properties of the propellant charge. The casing according to the invention is also fully dismountable and reusable.

Moreover, the casing improves the mechanical strength of the ammunition and notably the resistance of the combustible casings to drop tests. In fact, the proposed casing is rigid enough to maintain the part of the propellant charge it contains. It therefore transfers the stresses due to the inertia of the powder directly to the projectile, thereby protecting the combustible casing.

Lastly, the casing according to the invention can be adapted to all types of ammunition and notably to those wherein the primer tube is of a length such that it comes up to the tail-piece of this projectile.

Thus, the subject of the invention is a casing for a propellant charge, notably for a piece of ammunition. The propellant charge comprises a projectile and a stub. The casing comprises a substantially cylindrical envelope and a closing cover. The cylindrical envelope of the casing is made of a plastic material in the form of a lattice formed of strands defining openings.

The lattice is preferably a rectangular mesh. The opening of the mesh has a width less than the diameter of one of the grains of propellant powder intended to fill the casing. The rectangular length of the openings of the mesh can be parallel to an axis of the cylindrical envelope.

According to a preferred embodiment of the invention, the cylindrical envelope is obtained by rolling a plane sheet. The plane sheet preferably carries on one of its edges at least two tabs intended to cooperate with at least two slots formed on another edge of the sheet, so as to enable the edges to be joined to form the cylindrical envelope of the casing.

The casing can include means enabling it to be hooked onto a linking element integral with a projectile. The hooking means can be barbs intended to be inserted into openings formed in the linking element.

According to another characteristic of the invention, the closing cover of the casing is made of a plastic material and incorporates at least one opening. Preferably, the cover includes several openings in the shape of slots defined by arcs of a circle whose axis is the axis of the casing. The slots are evenly spaced angularly.

According to another characteristic of the invention, the cover can include an axial circular opening having at least three flexible radial strips. The cover will preferably include an outer cylindrical rim intended to cooperate with the cylindrical envelope of the casing. The rim can incorporate at least three hooks evenly spaced angularly and intended to cooperate with housings in the cylindrical envelope of the casing to lock the cover onto the envelope.

According to another embodiment of the invention, when the casing is intended to be made integral with a linking element which is itself integral with the projectile and is intended to be fastened to a stub by riveting, the cylindrical envelope can carry cups evenly spaced angularly and intended to lie opposite the riveting fastening holes made in the linking element.

BRIEF DESCRIPTION OF THE DRAWINGS

Other advantages of the invention will become apparent from reading the following description of the different embodiments made with reference to the annexed drawings in which.

DETAILED DESCRIPTION OF PREFERRED EMBODIMENTS

Figure 1:
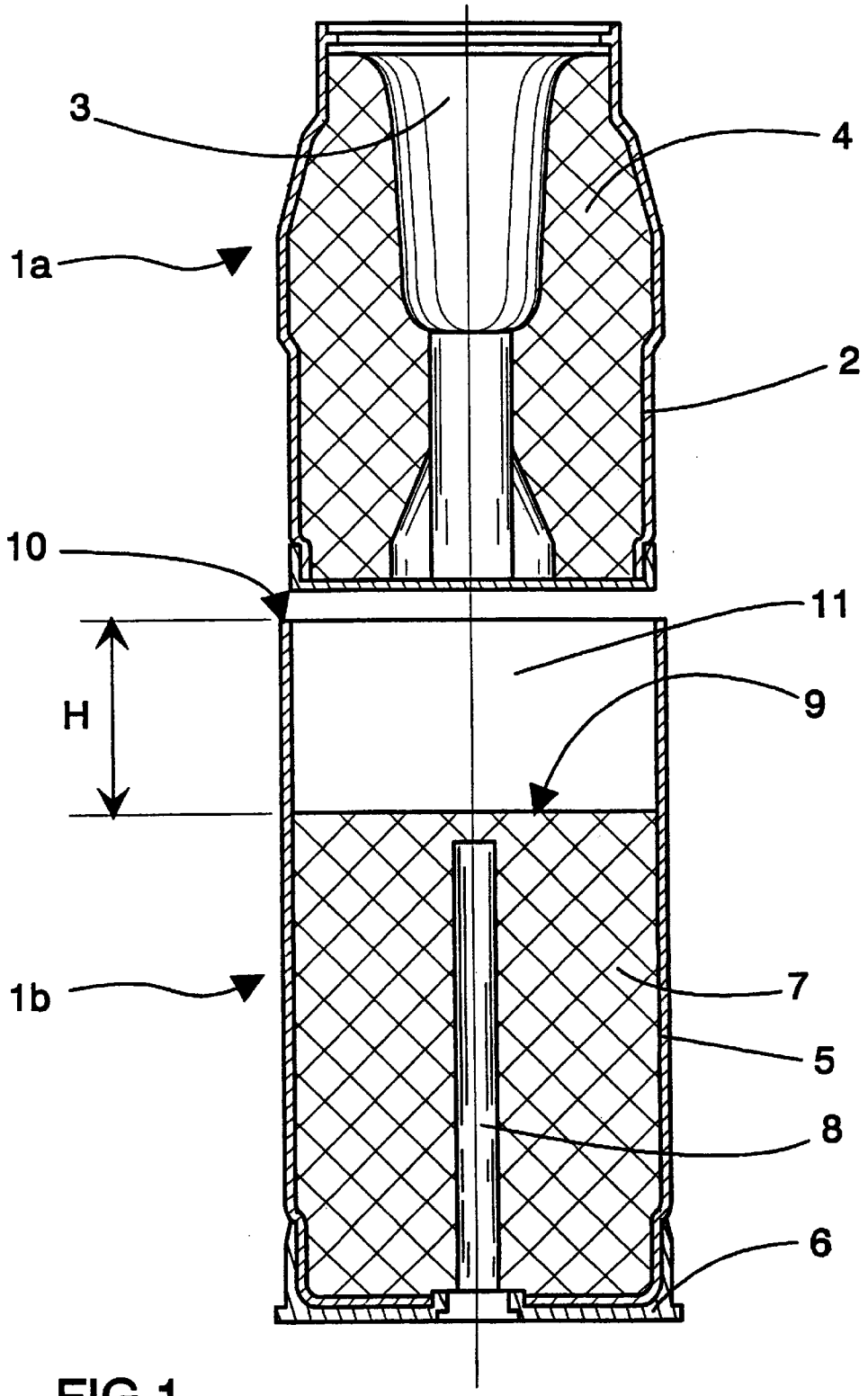
FIG. 1 is a simplified section view of a piece of ammunition incorporating a propellant charge casing according to the invention, such ammunition being shown before the stub and projectile are made integral.

FIG. 1 is an overall view of a propellant charge for a piece of ammunition of the type described in European Patent No. 314,547. The charge comprises a front element 1*a* and a rear element 1*b*. The front element 1*a* includes a casing 2, which encloses the tail end of a fin-stabilized projectile 3 (of which only the tail piece is shown) and a first propellant charge 4.

Rear element 1*b* comprises a stub 5, which integral with a base 6 and which encloses a second propellant charge 7. A primer tube 8 is integral with base 6 and extends longitudinally inside second charge 7.

The stub 5 can be a combustible stub. The stub 5 is not entirely filled with propellant powder. A height H between the upper surface 9 of the second propellant charge 7 and free end 10 of stub 5 is not filled with propellant powder. The free space 11 is intended to accommodate casing 2 containing the first propellant charge 4 integral with projectile 3.

Such a structure is described in detail in European Patent No. 314,547 whose entire description is included herein by way of reference. Reference to this patent will be made notably for the description of the loading and assembly process implemented to construct the ammunition.

Figures 2A, 2B:
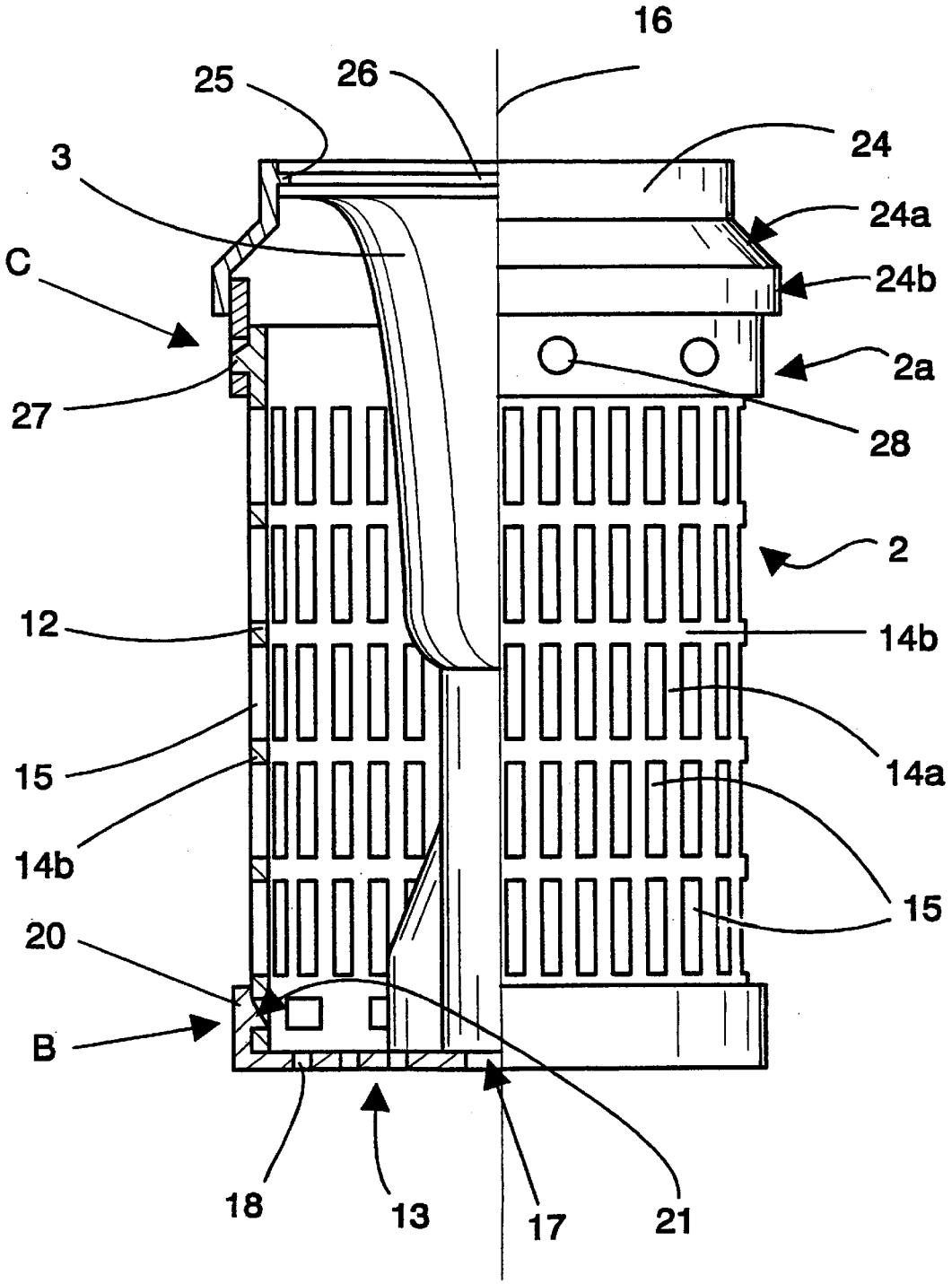
FIG. 2 is a view of the casing according to the invention fastened to a rear part of the projectile, the half view to the left (FIG. 2*a*) showing a section of the casing, and the half view to the right (FIG. 2*b*) showing an external view of the casing.

FIGS. 2*a* and 2*b* show a casing 2 for a propellant charge according to a first embodiment of the invention. The casing 2 is made of a plastic material, for example Polypropylene or a polyethylene copolymer. The casing 2 comprises a cylindrical envelope 12 and a closing cover 13. According to an essential characteristic of the invention, the envelope is formed by a lattice formed of strands 14*a*, 14*b*, which define openings 15. Here, strands 14*a* and 14*b* are orthogonal. The strands 14*a* are rectilinear and parallel to axis 16 of the casing (and thus to the ammunition stub). The strands 14*b* are circular and centered about axis 16. The openings of the lattice are thus rectangular.

The lattice is thus globally formed by the repetition of a rectangular elementary mesh constituted by an opening surrounded and defined by four strands. The length of the mesh rectangle is parallel to the axis 16 of cylindrical envelope 12. The width of the strands is selected such that the pressure of the propellant gases during firing of the ammunition causes the casing to fracture. Such a mesh-like structure therefore ensures the casing is rigid and lightweight while favouring the destruction of the casing during firing in conditions which prevent any risk of residue in the weapon chamber.

The openings also facilitate the radial passage of the flame thereby improving the combustion of the combustible stub 5. The orientation of the openings 15 with their length parallel to the axis of the casing makes the casing flexible, facilitating manufacture of the casing by rolling a sheet, as will be described below. Further, the openings 15 have a width which is smaller than the diameter of the grains of powder intended to be put in the casing to form the first propellant charge 4. This ensures that the grains of powder are kept in place by the casing. Such an arrangement will be unnecessary if propellant charge in bundles is used.

The dimensions of the mesh are defined so as to ensure a maximum open surface while guaranteeing sufficient rigidity for the casing and retention of the grains of powder. A further advantage of such an envelope structure is that, during loading, the grains of powder press randomly against the edges of the openings 15. As a result, the grains are oriented randomly. This allows the casing to be filled without creating stacks of power likely to disturb the interior ballistics during firing.

Figure 3:
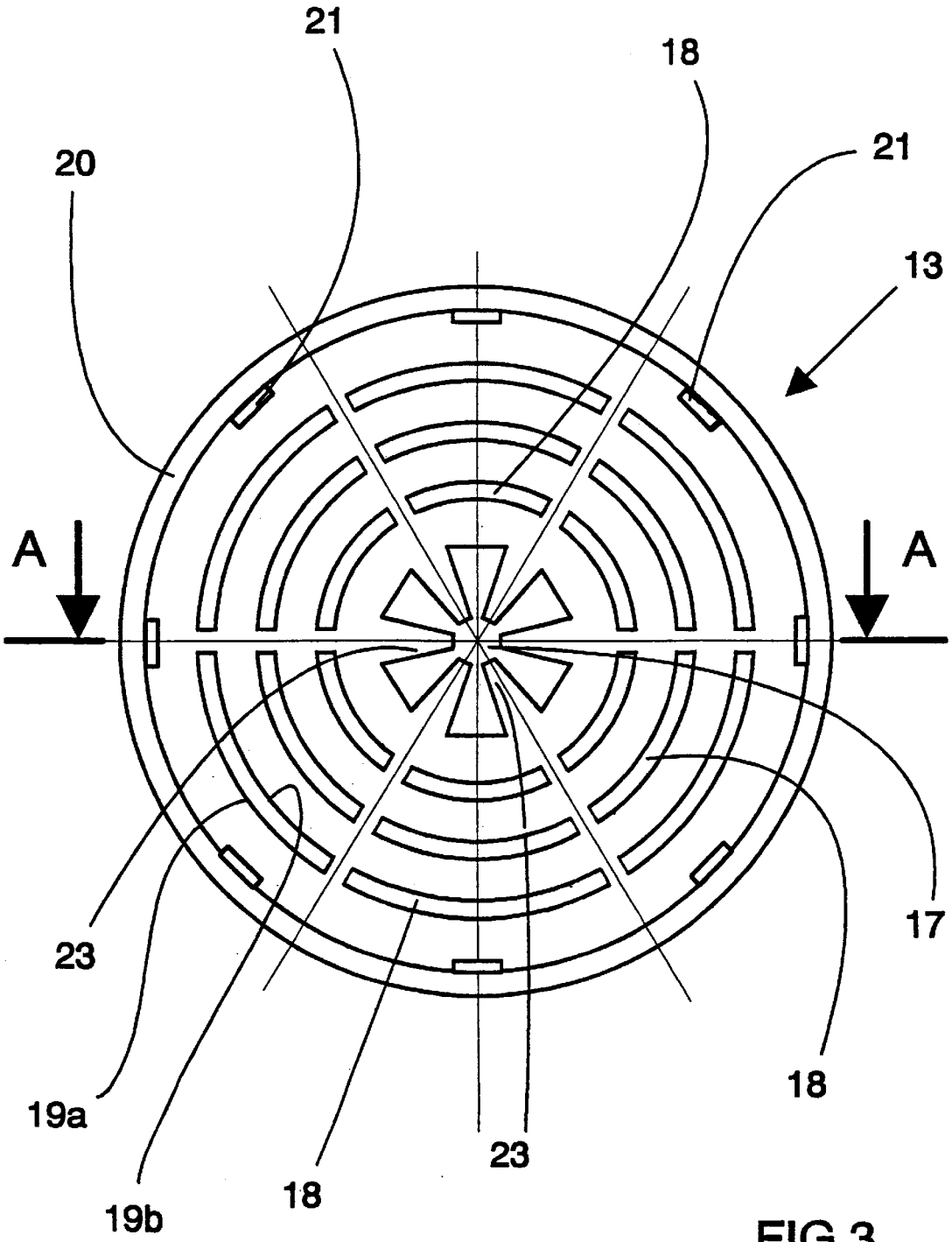
FIG. 3 is a view of the casing cover alone.
Figure 4:
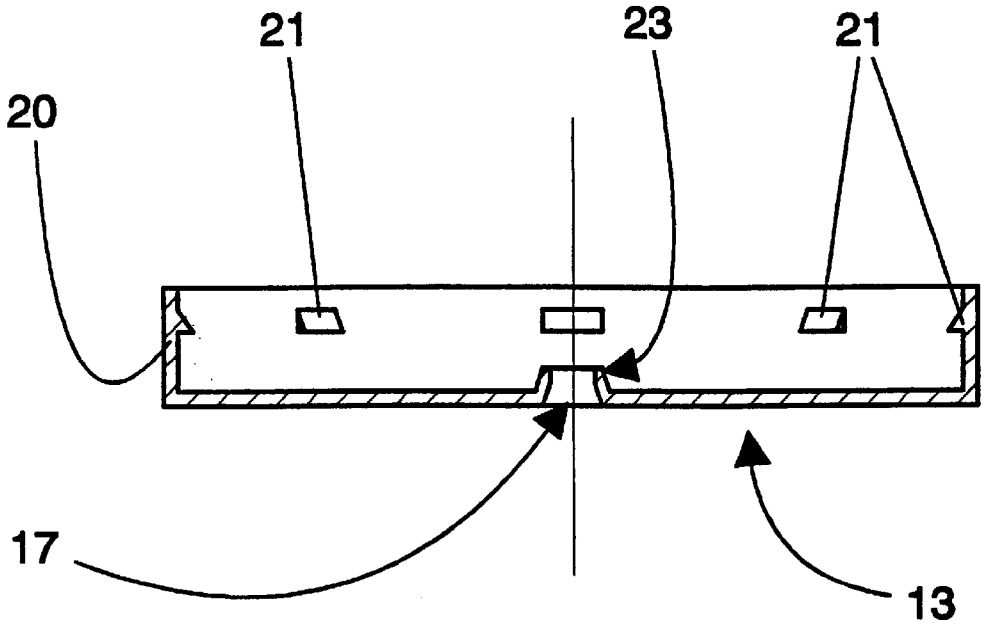
FIG. 4 is a section of FIG. 3 along plane AA.

The casing 2 is closed by the cover 13 which can also be seen in FIGS. 3 and 4. The cover 3 is also made of a plastic material. It has a circular axial opening 7, as well as several other openings in the shape of slots defined by arcs of circles 19*a*, 19*b*, whose axis is axis 16 of the casing. These slots are angularly evenly spaced. The purpose of the slots 18 is to facilitate priming of the propellant charge contained in the casing by means of the charge contained in the stub, and to embrittle the cover so that it fragments during firing.

The cover 13 also has an external cylindrical rim 20 intended to cooperate with the cylindrical envelope 12 of the casing 2. On its inner surface intended to be positioned opposite the envelope 12, the rim 20 includes at least three hooks 21 angularly evenly spaced (FIG. 3 shows eight hooks). The hooks 21 are intended to cooperate with housings 22 carried by the cylindrical envelope 12 to ensure axial locking of the cover 13 and the envelope 12.

Figure 6:
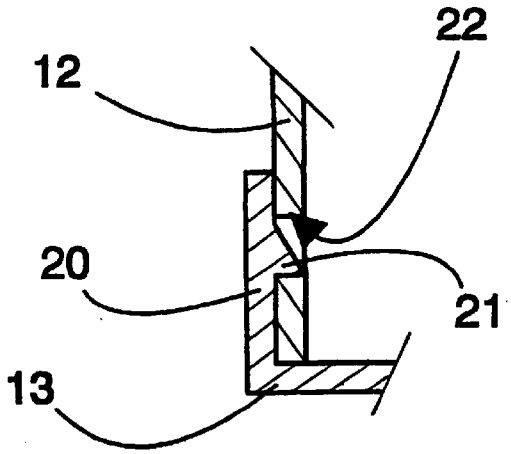

FIG. 6 shows the locking means in detail (also shown by arrow B in FIG. 2*a*) The hooks have a bevelled profile which makes it easier to introduce the cover 13 onto the envelope 12.

The axial opening 17 of cover 13 has at least three flexible radial strips 23 (FIG. 3 shows six). The strips, which can be seen in FIGS. 3 and 4, extend radically into opening 17 can be folded to allow passage of a primer tube, as will be described hereafter with reference to FIGS. 7*a* and 7*b*.

The length of strips 23 is selected such that the diameter of the circle defined by their free ends is less than the diameter of the grains of powder intended to fill casing 2. It is therefore impossible for the propellant charge to leak from the casing 2 via the axial opening 17.

The casing according to the invention is fastened by its upper part 2*a* to a linking elements 24 integral with a projectile (see FIGS. 2*a*, 2*b*). This linking element 24 will be, for example, a part made of a plastic material and having a rib 25 housed in a ring-shaped groove 26 of projectile 3. A conical part 24*a* and a cylindrical part 24*b* of the linking element 24 have substantially the same diameter as the stub 5.

Such a linking element is described, for example, in European Patent No. 307,307. The casing 2 includes means enabling it to be hooked on the linking element 24. The hooking is fully reversible and dismountable.

Figure 5:
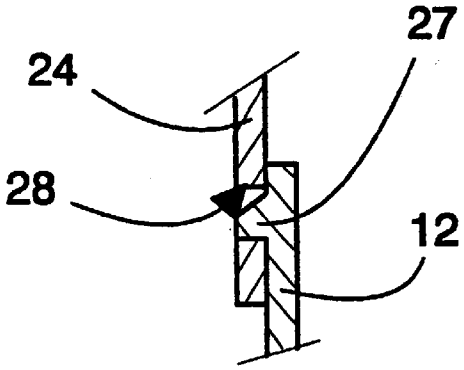
FIGS. 5 and 6 are detailed views showing the means to hook the casing onto the linking element (FIG. 5) and the means to lock the cover onto the casing (FIG. 6)

These hooking means are barbs 27 intended to be inserted into openings 28 in linking element 24. FIG. 5 shows these hooking means in detail (also shown by arrow C in FIG. 2*a*). The barbs are cylindrical and have a bevelled profile, which makes it easier to insert them into the openings 28.

The envelope 12 and the cover 13 can easily be made by injection molding. A single injection molding operation allows the manufacture of the envelope or the cover along with the locking means (hooks 21) and hooking means (barbs 27), as well as the different openings (15, 18) and housings (22).

Figure 8:
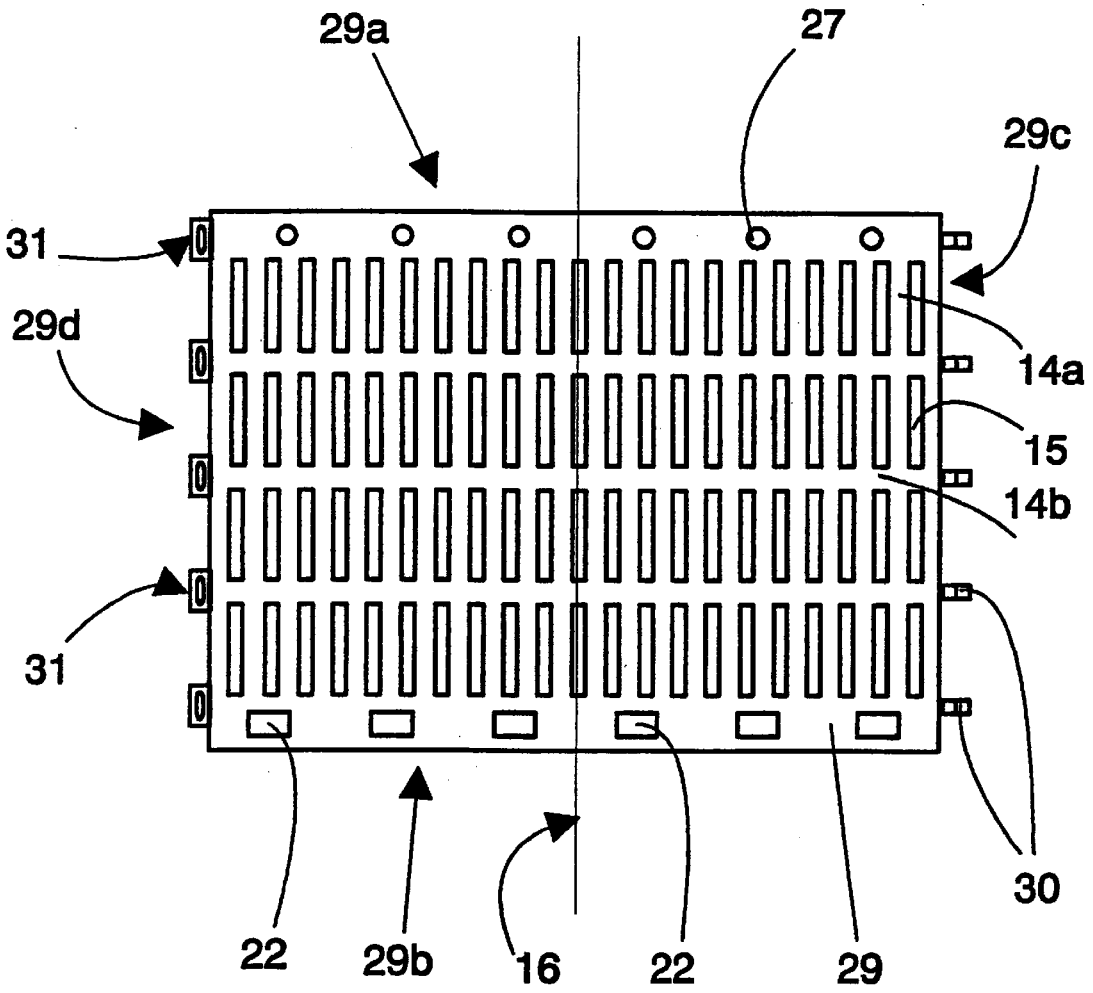
FIG. 8 shows the open-worked plane sheet with which the casing envelope is made.

According to one variation of the invention, it would be particularly advantageous to make the cylindrical envelope 12 by rolling a plane sheet. FIG. 8 shows such a plane sheet 29, which has rectangular openings 15 defined by strands 14*a* and 14*b*. On an upper edge 29*a*, sheet 29 also has a row of barbs 27 and, on a lower edge 29*b*, a row of housings 22. The plane sheet 29 also has at least two tabs 30 (five tabs are shown) on one of its lateral edges 29*c*. The tabs are intended to cooperate with slots 31 on another lateral edge 29*d* of the sheet, so as to enable the two lateral edges to be joined with one another to form the cylindrical envelope 12. Such an envelope is easy to disassemble and reassemble.

In the example described above, the slots 31 are in the shape of rectangular slits of substantially the same dimensions as the tabs 30 and are formed in windows projecting from the lateral edge 29*d*. The axis 16 of the envelope 12 formed by joining the lateral edges 29*a*, 29*b* is shown as a guide in FIG. 8 so as to indicate the way it is to be rolled. This axis 16 is parallel to the lengths of the rectangular openings 15.

Figure 10A:
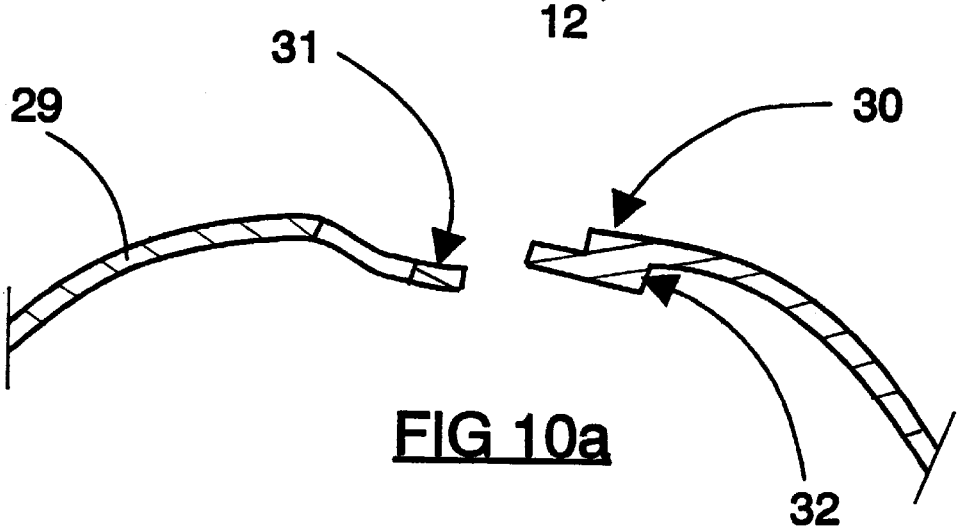
FIGS. 10*a* and 10*b* are detailed views showing the means to connect the edges of the open-worked plane sheet in order to make the casing with FIG. 10*a* showing the two edges before connection and FIG. 10*b* showing these two edges after connection.
Figure 10B:
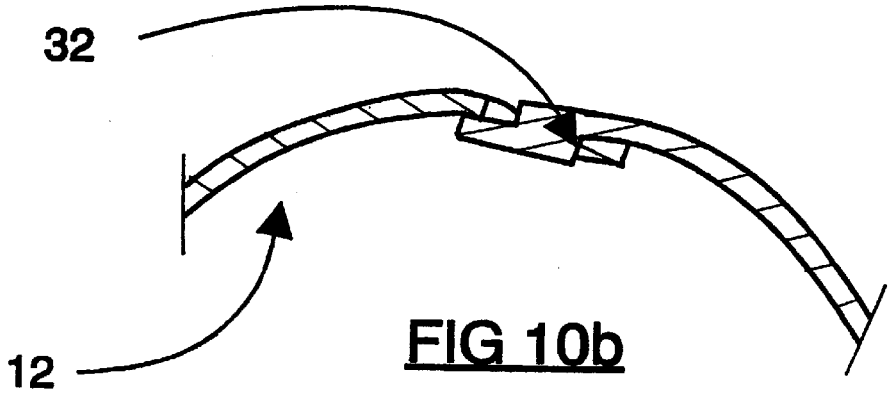

FIGS. 10*a* and 10*b* show the different phases to install the tabs 30 in the slots 31. The profile of the tab 30 is selected such that, after its introduction into the corresponding slot 31, a rim 32 of the tab 30 comes to abut against one side of the slot 31 thus locking it in place. This makes it easier to manufacture the cylindrical envelope 12 of the casing 2 by simplifying the tooling, and thus reducing the manufacturing costs. By reducing the volume of the cylindrical envelope, it also facilitates the storage and transportation of the casing components before assembly of the ammunition.

Figures 7A, 7B:
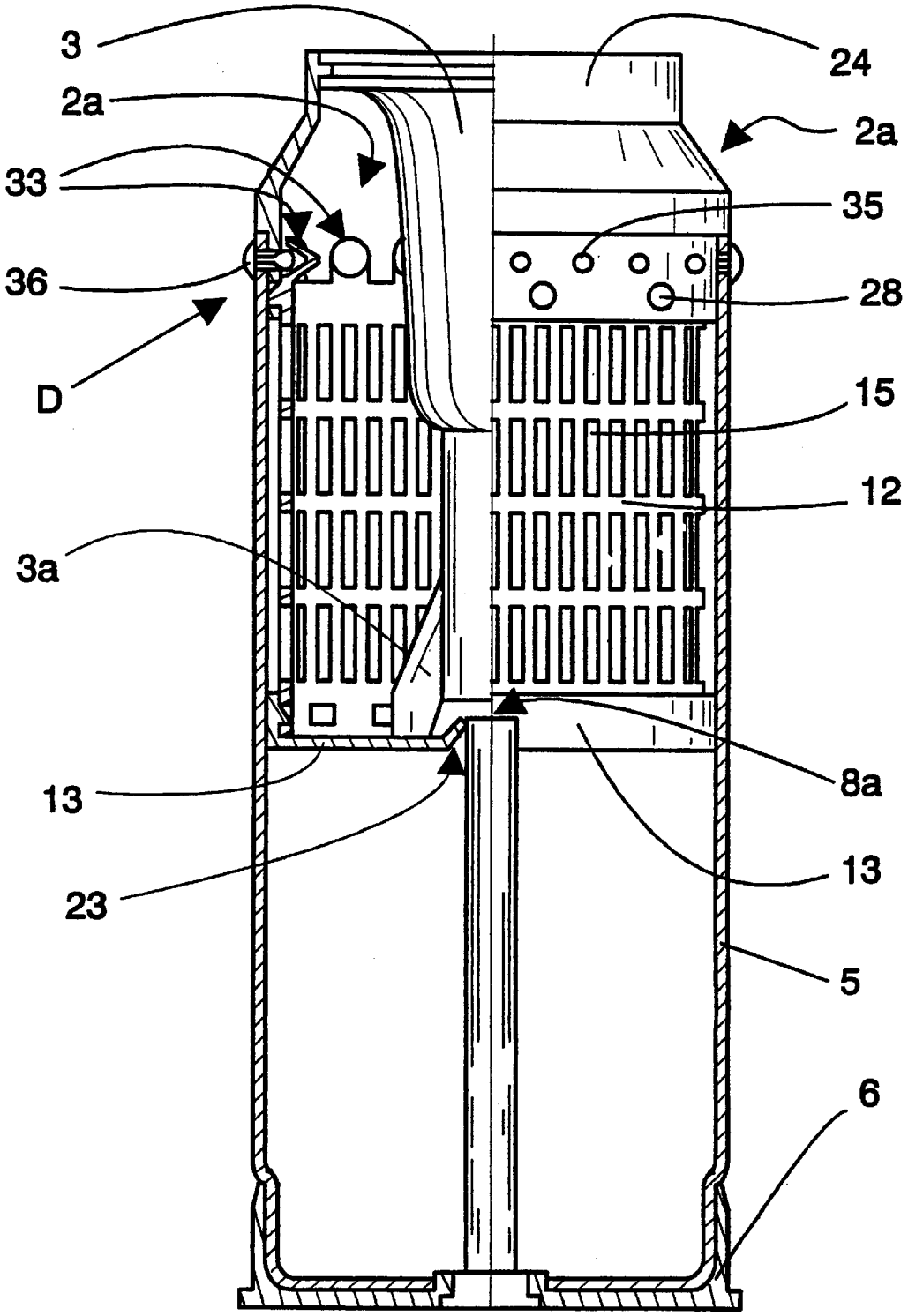
FIG. 7 is a view of a second embodiment of the casing according to the invention fastened to a rear part of the projectile, the half view to the left (FIG. 7*a*) showing a section of the casing, the half view to the right (FIG. 7*b*) showing an external view of the casing.

FIGS. 7*a* and 7*b* show a second embodiment of a casing according to the invention. These figures also highlight the use of a casing according to the invention in a piece of ammunition in which the tail piece 3*a* of the projectile 3 penetrates deeply into the propellant charge and thus reaches the vicinity of the upper end 8*a* of primer tube 8. The cover 13 is in contact with tail piece 3*a* and the plane it defines therefore intersects primer tube 8.

The axial opening 17 is of a diameter selected to be greater than that of a primer tube 8. The flexible radial strips 23 allow the introduction of the end of primer tube 8 into the casing 2. By virtue of the axial opening 17 and the strips 23, the ammunition can be easily assembled and disassembled without deteriorating the casing 2 and without spillage of the propellant charge which it contains.

The embodiment shown in FIGS. 7*a* and 7*b* also differs from the preceding embodiment in that, on an upper edge 2*a* of the casing, it has cups 33 angularly evenly spaced. This embodiment is more particularly intended for a casing fastened to a linking element 24, which is itself intended to be made integral with a stub 5 by riveting.

Figure 9:
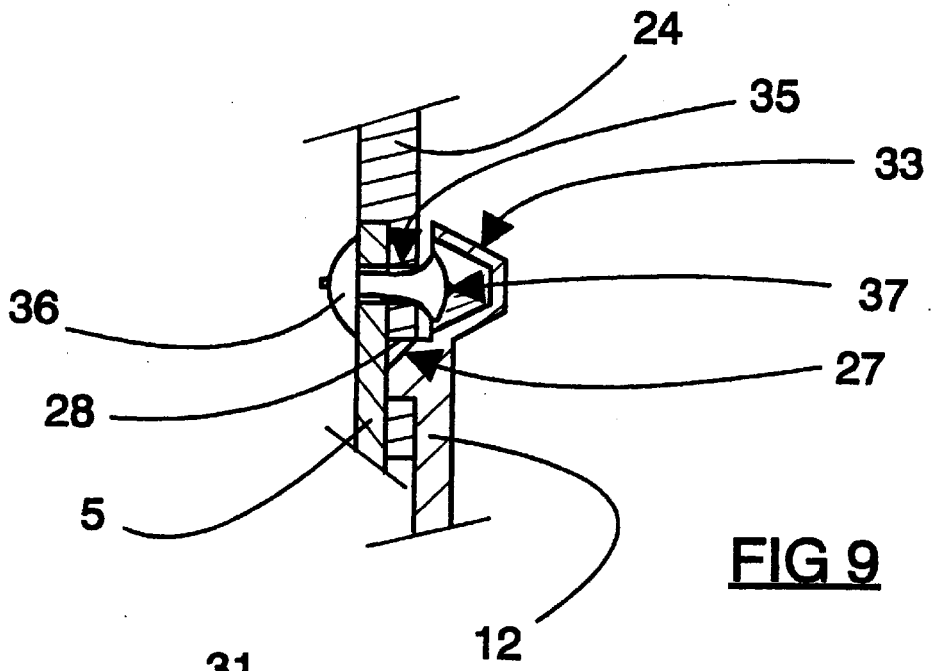
FIG. 9 is a detailed view of the cups carried by the casing.

The linking element 24, in this case, has fastening holes 35 for receiving rivets 36. The rivets 36, commonly used in such fastenings, have an axial needle which when pushed through the fastening holes 35 deforms to provide the required link. This is shown in detail in FIG. 9 and more generally in FIG. 7*a* as indicated by arrow D.

The cups 33 have a tapered profile and are arranged such that, after assembly of the casing 2, they lie opposite the fastening holes 35 of the linking element 24. The cups 33 are arranged opposite the rivet 36 and during the assembly of the ammunition, enables the rivets 36 to be set in place without being hindered by the presence of grains of powder blocking the fastening holes.

The cups 33 also provide the advantage of preventing the possible ejection of the needle 37 from rivet 36 into the propellant charge when the ammunition is subjected to vibrations. Such ejection of the needle 37 may cause the loss of the rivet 36 and disconnection of the linking element 24 and the stub 5. The cups 33 are formed by injection molding along with the sheet 29.

In order to make it easier to disassemble the ammunition afterwards, the bottom of the cup 33 has a wall thickness such that it can be perforated by a deliberate action on the needle 37 to push it from rivet 36.

Different variants are possible without departing from the scope of the invention. It is also possible to design a casing whose cylindrical envelope is in the form of a lattice with a different mesh geometry, for example, having diamond-shaped openings. It is also possible to design a casing 12 whose cylindrical envelope 12 is obtained directly by injection molding, thus avoiding the manufacture of the plane sheet.

We claim:

1. A casing for housing propellant charge for a piece of ammunition, the ammunition comprising a projectile housed within said casing along with said propellant charge and a stub, containing an ignitor, configured to be engaged with said casing, said casing comprising:

a substantially cylindrical envelope forming an outer surface of said casing; and a closing cover enclosing an end of said cylindrical envelope, wherein said cylindrical envelope is made of a plastic material and is in the shape of a lattice formed by strands defining openings in the outer surface of said casing.

2. The casing according to claim 1, wherein said lattice is formed of a repetitive rectangular mesh, and wherein a width of said openings is less than a predetermined diameter of a grain of said propellant charge.

3. The casing according to claim 2, wherein a longitudinal length of said mesh runs parallel to an axis of the cylindrical envelope.

4. The casing according to one of claim 1, wherein said cylindrical envelope is formed by rolling a plane sheet.

5. The casing according to claim 4, wherein at least two tabs are formed on one edge of said plane sheet, said at least two tabs being configured to cooperate with at least two slots formed on another edge of said plane sheet so as to enable the edges to be joined to form said cylindrical envelope.

6. The casing according to claim 1, further comprising means for hooking said cylindrical envelope onto a linking element of a projectile.

7. The casing according to claim 6, wherein said hooking means comprise barbs configured to be insertable into openings in the linking element.

8. The casing according to one of claim 1, wherein said closing cover is made of a plastic material and includes at least one opening.

9. The casing according to claim 6, wherein said closing cover includes several openings comprising slots defined by arcs of a circle whose axis is an axis of the casing, wherein said slots are evenly angularly spaced.

10. The casing according to claim 8, wherein said closing cover comprises an axial circular opening having at least three flexible radial strips.

11. The casing according to claim 8, wherein said closing cover further comprises an outer cylindrical rim configured to cooperate with the cylindrical envelope.

12. The casing according to claim 11, wherein the outer cylindrical rim comprises at least three hooks angularly evenly spaced and configured to cooperate with housings in the cylindrical envelope to lock the closing cover onto the cylindrical envelope.

13. The casing for a propellant charge according to claim 1 formed integral with a linking element, which is itself formed integral with a projectile and intended to be fastened to a stub by riveting, wherein said cylindrical envelope comprises cups angularly evenly spaced and configured to lie opposite the riveting fastening holes formed in the linking element.

* * * * *